US009175431B2

(12) United States Patent
Kim et al.

(10) Patent No.: US 9,175,431 B2
(45) Date of Patent: Nov. 3, 2015

(54) LAUNDRY MACHINE

(75) Inventors: Sang Hun Kim, Changwon-si (KR); Soo Bong Kim, Changwon-si (KR); Jung Tae Song, Changwon-si (KR); Ig Geun Kwon, Changwon-si (KR); Suk Yun Moon, Changwon-si (KR); Hee Tae Lim, Changwon-si (KR); Dong Il Lee, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 1081 days.

(21) Appl. No.: 13/142,934

(22) PCT Filed: Dec. 29, 2009

(86) PCT No.: PCT/KR2009/007868

§ 371 (c)(1),
(2), (4) Date: Oct. 11, 2011

(87) PCT Pub. No.: WO2010/077055

PCT Pub. Date: Jul. 8, 2010

(65) Prior Publication Data

US 2012/0017649 A1 Jan. 26, 2012

(30) Foreign Application Priority Data

Dec. 31, 2008 (KR) ..... 10-2008-0138077

(51) Int. Cl.
*D06F 39/08* (2006.01)
*D06F 37/26* (2006.01)

(52) U.S. Cl.
CPC ..... *D06F 39/088* (2013.01); *D06F 37/26* (2013.01)

(58) Field of Classification Search
CPC ..... D06F 39/088
See application file for complete search history.

(56) References Cited

U.S. PATENT DOCUMENTS

| | | | | |
|---|---|---|---|---|
| 3,022,656 A | 2/1962 | Bergeson et al. | ..... | 68/207 |
| 3,038,639 A | 6/1962 | Anderson | ..... | 222/70 |
| 4,489,574 A * | 12/1984 | Spendel | ..... | C11D 3/386 68/16 |
| 2004/0025544 A1 * | 2/2004 | Kim | ..... | D06F 39/083 68/3 R |

FOREIGN PATENT DOCUMENTS

| | | |
|---|---|---|
| CN | 1851103 A | 10/2006 |
| CN | 1851130 A | 10/2006 |
| DE | 43 30 079 A1 | 3/1995 |
| DE | 197 31 667 A1 | 1/1999 |
| DE | 10 2007 023 020 B3 | 5/2008 |
| EP | 0 655 523 A1 | 5/1995 |

(Continued)

OTHER PUBLICATIONS

Chinese Office Action dated Aug. 1, 2013 issued in Application No. 200980155052.3 (with English translation).

(Continued)

*Primary Examiner* — Jason Ko
(74) *Attorney, Agent, or Firm* — Ked & Associates, LLP

(57) ABSTRACT

The present invention relates to a laundry machine for treating laundry. One embodiment of the laundry machine may include a water supply valve, a drum (30) in which laundry is placed, a tub (20) in which the drum (30) is rotatably placed, the tub (20) having an extended portion (23*a*) which extends forward and have an opening at a front portion thereof for laundry entrance, and a tub water supply portion (140), and a water supply line to guide water from the water supply valve to the tub water supply portion (140).

14 Claims, 5 Drawing Sheets

(56) References Cited

FOREIGN PATENT DOCUMENTS

| | | | |
|---|---|---|---|
| EP | 1 433 890 | A2 | 6/2004 |
| EP | 1 433 891 | A2 | 6/2004 |
| EP | 1 445 368 | A2 | 8/2004 |
| EP | 1 605 088 | A2 | 12/2005 |
| EP | 1 715 097 | A1 | 10/2006 |
| EP | 1 746 192 | A2 | 1/2007 |
| GB | 2 029 862 | A | 3/1980 |
| KR | 10-2005-0081459 | A | 8/2005 |
| KR | 10-0587307 | A | 6/2006 |
| KR | 10-2006-0111286 | A | 10/2006 |
| KR | 10-2007-0055182 | A | 5/2007 |
| RU | 2 295 597 | C2 | 3/2007 |
| WO | WO 2008/075198 | A2 | 6/2008 |

OTHER PUBLICATIONS

Russian Notice of Allowance dated Aug. 29, 2013 issued in Application No. 2011132067/12 (with English translation).

PCT International Search Report dated Sep. 13, 2010 issued in Application No. PCT/KR2009/007868.

European Search Report dated Jul. 31, 2012 issued in Application No. 09 83 6376.

Notice of Allowance issued in Application No. 10-2008-0138077 dated Jul. 29, 2015.

* cited by examiner

LAUNDRY MACHINE

TECHNICAL FIELD

The present invention relates to a laundry machine for treating laundry.

In the laundry machine, there are washing machines and dryers, typically. Particularly, in the washing machines, there are pulsator type washing machines and drum type washing machines. Of the washing machines, there are washing and drying machines for performing, not only washing, but also drying.

BACKGROUND ART

The drum type washing machine is provided with a tub arranged in a horizontal direction, with a drum mounted therein horizontally.

The drum type washing machine is provided with a water supply valve connected to a water supply system for water supply, and a detergent box for holding detergent. Between the water supply valve and the detergent box and between the detergent box and the tub, a water supply hose is connected.

Therefore, the water from the water supply valve is supplied to the tub through the detergent box.

In order to have the water supplied thereto, the tub has the water supply hose connected to middle thereof.

In order to circulate the water in the tub, the drum type washing machine may be provided with a circulating pump. For the circulation of the water, a circulating flow passage is formed from an underside to a upper side of the tub. Accordingly, as the circulating pump is put into operation, the water is pumped up from the underside of the tub to the upper side of the tub.

In the meantime, of related art drum type washing machines, there is one that is provided with a heater in the tub. By heating the water by using the heater and using the heated water, a washing capability is improved. However, the requirement for heating a large amount of water in the tub requires much energy. The heating of the water in the tub to elevate a temperature of the laundry or the environment thereof to a desired temperature is not efficient in view of energy.

Recently, a washing machine provided with a steam generator is come into market. In the washing machine, steam is supplied to the tub or the drum, for improving the washing capability as well as energy efficiency.

One of important factor related to the washing capability is the temperature of the laundry or an environment thereof. Accordingly, of methods for elevating the temperature of the laundry or the environment thereof, using efficient one of the methods is desirable.

In this point of view, supply of the steam to the tub or the drum is more energy efficient than heating an entire water. The energy will be saved signifimaytly if a small amount of the water is turned to steam, rather than heating an entire water, and the steam is sprayed to the laundry directly.

Moreover, since the steam has a high temperature, the temperature of the laundry or an environment of the laundry may be elevated higher, thereby improving the washing capability more.

DISCLOSURE OF INVENTION

Technical Problem

The present invention is to provide a new laundry machine which a new water supply structure is provided to.

By employing a structure in which water is supplied from a front of a tub, a washing machine is made to perform more efficient washing.

Technical Solution

One embodied laundry machine may include a water supply valve, a drum in which laundry is placed, a tub in which the drum is rotatably placed, and a water supply line to guide water from the water supply valve to the tub water supply portion.

The tub may have a water supply hole in a front portion thereof. The water supply hole may be located in front of the drum, especially in front of an opening for laundry entrance of the drum. Water supplied through the water supply hole may be directly supplied to laundry inside the drum.

The tub may have an extended portion which extends forward from a front wall and the water supply hole may be formed in the extended portion.

The water supply valve may be connected to a water supply system which is an external water supply source.

The water supply line may be made to pass through the detergent box which holds detergent. Accordingly, the water from the water supply valve may be introduced to the tub through the water supply hole via the detergent box. Hoses may be connected between the water supply valve, the detergent box and the water supply hole.

A hose may be inserted into the water supply hole.

A water flow guide may be further provided for guiding the water to be directed toward an inside of the drum.

The water flow guide may be shaped to make the water being supplied be spread widely as far as possible.

The water flow guide may include at least one division plate to provided two or more flow passages.

The water flow guide may include a laundry stopper which is extended downward from an end thereof for keeping the laundry inside the drum.

The laundry stopper may be in triangular shape.

A front gasket may be mounted to the tub extended portion. The front gasket seals a gap between the tub and a door, for preventing the water from leaking to an outside of the washing machine.

The water flow guide may be formed at the gasket.

The water flow guide may have ribs. The ribs support sagging of the water flow guide. Since the gasket is flexible, the water flow guide may sag down due to gravity of the water and the water flow guide at the time the water is being supplied. The ribs prevent the water flow guide from sagging down. In detail, the ribs may be formed between portions where the front gasket is connected to the tub extended portion and an upper surface of the water flow guide.

The ribs may provide an effect of spreading the water being supplied. That is, the ribs may serve to divide the water being supplied. That is, the ribs may serve as the division plate.

Depending on cases, two or more than two water supply hoses may be connected, and the ribs may be used as separators in supplying different fluids through different hoses.

On an outside of the water supply hose, there is a coupling groove for placing in and coupling to an edge of the water supply hole.

The water supply hose of a flexible material may be connected to the tub securely as the edge of the water supply hole is placed in the coupling groove.

Moreover, the water supply hose may include a branch hose extended outward additionally. The branch hose may be connected to another external fluid supply portion. For an example, the branch hose may be directly connected to the water supply system for guiding clean water from the water supply system to the tub.

In the laundry machine, the tub may be fixedly supported, or be supported by a flexible support structure, such as the suspension unit.

Further, the tub may be supported in an interim state between the fixed support and the flexible support.

That is, the tub may be flexibly supported by the suspension unit or be rigidly supported. For example, the tub may be supported by the suspensions, be supported by rubber bushings to provide less flexible movement than when supported by the suspensions, or be fixedly supported by being fixed somewhere by screws or so.

For another instance, the cases where the tub is supported more rigidly than when supported by the suspension unit are as follows.

Firstly, the tub may be made integrally with the cabinet.

Next, the tub may be supported by being fastened by screws, ribets, rubber bushings, etc. Also, the tub may be welded or bonded to the cabinet. In this cases, the supporting or fastening members have larger stiffnesses than a stiffness of the suspension unit with respect to the main direction of the vibration of the drum.

The tub may be expanded within the limits of a space in which the tub is placed. That is, the tub may be expanded until the circumferential surface thereof reaches (or almost reaches) a side wall or a side frame (for example, a left or right plate of a cabinet) restricting the size of the space at least in the lateral direction (the direction laterally perpendicular to the axial direction of the rotary shaft when the rotary shaft is horizontally placed). The tub may be made integrally with the lateral side walls of the cabinet.

The tub may be formed to be closer in the lateral direction to the wall or the frame than the drum. For example, the tub may be spaced away from the wall or the frame by an interval of less than 1.5 times an interval with the drum. Under the condition that the tub is enlarged in the lateral direction, the drum may also be enlarged in the lateral direction. Further, if the lateral interval between the tub and drum is reduced, the drum may be expanded in the lateral direction in direct proportion. When the lateral interval between the tub and the drum is reduced, the vibration of the dram in the lateral direction may be considered. The weaker the vibration of the drum in the lateral direction, the more expanded is the diameter of the drum. Therefore, the suspension unit to reduce the vibration of the drum may be designed such that rigidity of the suspension unit in the lateral direction is greater than rigidities of the suspension unit in other directions. For example, the suspension unit may be designed such that rigidity of the suspension unit against displacement in the lateral direction is greatest compared with rigidities of the suspension unit against displacements in other directions.

Further, the suspension unit may be directly connected to the bearing housing supporting the rotary shaft. That is, the bearing housing comprises a supporting portion to rotatably support the shaft and an extended portion extended from the supporting portion, and the suspension unit is attached to the supporting portion of the bearing housing or the extended portion of the bearing housing.

The suspension unit may include brackets extended in the axial direction. In a front loading type laundry machine, the brackets may be extended forward, namely towards a door.

The suspension unit may comprises at least two suspensions which are arranged distant from each other in the axial direction of the shaft.

The suspension unit may comprise suspensions placed below the shaft for standing support. The supported object (for example, the drum) is supported by the suspensions to stand alone.

Alternately, the suspension unit may comprise suspensions placed over the shaft for hanging support. In this case, the supported object is supported to be hung.

The mass center of the vibrating object (for example, a combination of the drum, the shaft, the bearing housing, and the motor) may be located, with respect to the center of the longitudinal length of the drum, at a side where the motor is located. In a front loading type laundry machine, the mass center may be located behind the longitudinal center of the drum. In this case, at least one suspension may be placed in front of or behind the mass center. One suspension may be placed in front of the mass center and another suspension behind the mass center.

The tub may be provided with an opening at a rear portion thereof. The drive assembly may be connected to the tub by a flexible member. The flexible member may seal between the tub and the drive assembly to prevent water from leaking through the opening of the rear portion of the tub, and allow the drive assembly to move relatively to the tub. The flexible member may be made of a flexible material which, can do the sealing, for example, a gasket material like a front gasket. In this case, the flexible member may be referred to as a rear gasket for convenience. The rear gasket may be connected to the drive assembly under the condition that the rotation of the rear gasket at least in the rotational direction of the rotary shaft is constrained. In one embodiment, the flexible material may be directly connected to the shaft. In another embodiment, the flexible material may be connected to a portion of the bearing housing.

Further, a portion of the drive assembly, which is located radially inside the rear gasket and thus is likely to be exposed to the water in the tub, may be made so as no to be corroded by the water. For example, the portion of the drive assembly may be coated, or be surrounded with a separate member made of plastic such as the tub back (which will be described below). In a case where the portion of the drive assembly is made of metal, the portion may not be directly exposed to water by the coating or the separate plastic member, and thus corrosion of the portion may be prevented.

Further, the cabinet may not be necessary. For example, in a built-in laundry machine, the laundry machine without the cabinet may be installed within a space of a wall structure. However, even in this case, a front plate forming the front face of the laundry machine may be required.

Advantageous Effects

Water may be supplied in front of a drum, whereby the water may be supplied directly to laundry. An amount of water used for washing may be reduced.

Also, detergent may be supplied directly to the laundry and it may help to save an amount of detergent and keep the tub clean from the detergent remaining on the bottom thereof.

MODE FOR THE INVENTION

Reference will now be made in detail to the specific embodiments of the present invention, examples of which are illustrated in the accompanying drawings. Wherever possible, the same reference numbers will be used throughout the drawings to refer to the same or like parts.

Figure 1:
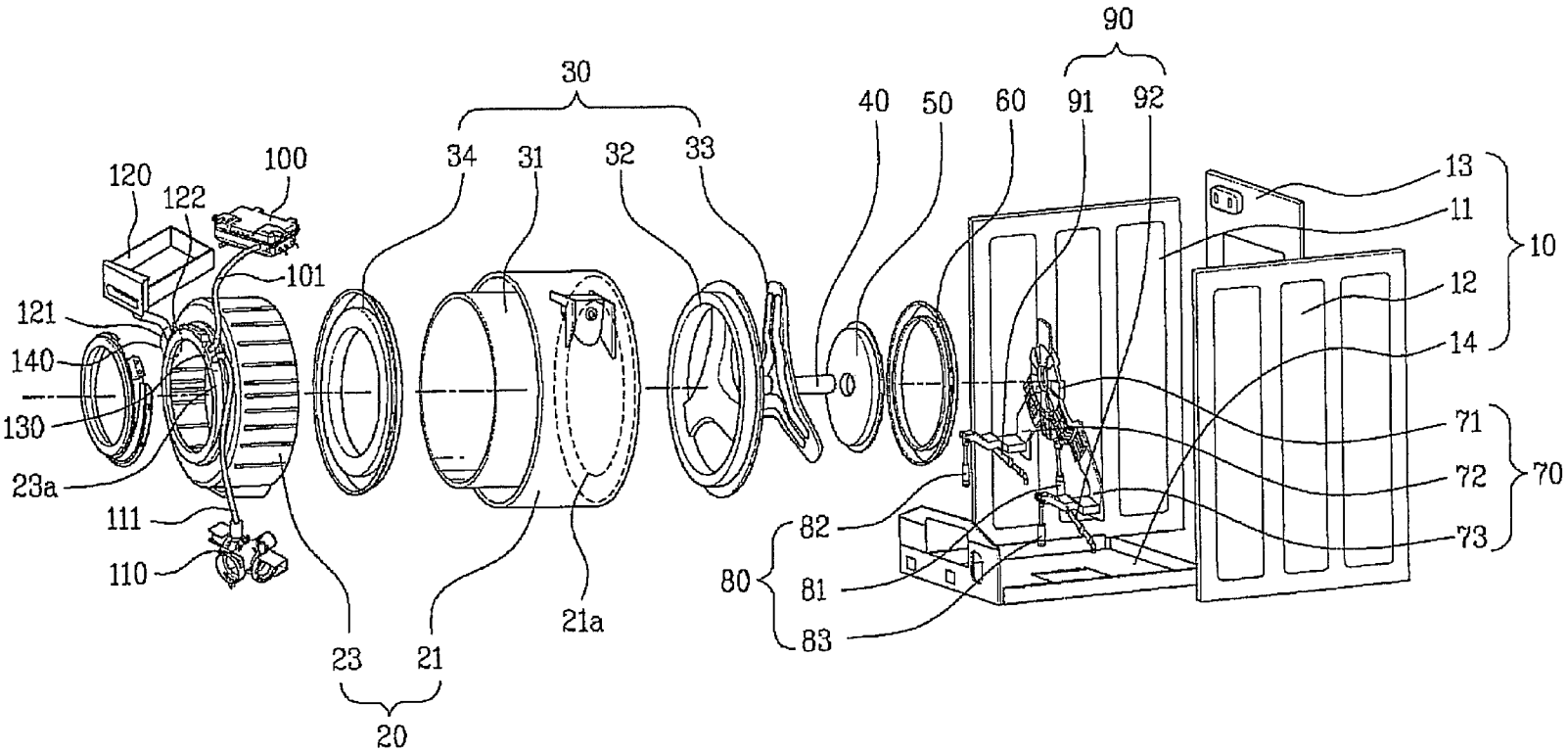
FIG. 1 illustrates an exploded perspective view of a washing machine in accordance with a preferred embodiment of the present invention, partially.

FIG. 1 illustrates an exploded perspective view of a washing machine in accordance with a preferred embodiment of the present invention, partially.

There is a cabinet 10 forming an exterior of the washing machine having a front frame (not shown), a left side frame 11, a right side frame 12, a rear frame 13, and a bottom panel 14.

A tub 20 is mounted in the cabinet 10, and the tub 20 is rotatably mounted in a drum 30.

The tub 20 holds water which flows into the drum 30 through a plurality of pass through holes in the drum 30.

The tub 20 includes a cylindrical tub rear 21 and a tub front 23 coupled to a front of the tub rear 21. The tub rear 21 has a rear opening 21*a*.

The tub front 23 has a tub extended portion 23 or a rim projected from the tub front 23 to form a front opening for laundry introduction.

The tub extended portion 23*a* has a front gasket 150 mounted thereto for sealing between the tub 20 and a door (not shown).

The door is coupled to the front panel of the cabinet 10 with a hinge for opening/closing the front opening in the tub extended portion 23*a* of the tub front 23. the introduction/taking out the laundry to/from the washing machine is made as the door is opened/closed.

The drum 30 includes a drum center 31, a drum front 34 coupled to a front of the drum center 31, and a drum back 32 coupled to a rear of the drum center 31.

The drum 30 has the laundry therein for washing the laundry.

The drum is positioned in rear of the tub extended portion 23*a*. The tub comprises a lateral side wall and a front wall. The lateral side wall surrounds the circumferential surface of the drum, and the front wall is attached to the front end of the lateral side wall. The front wall is in flat shape as a whole. The tub extended portion is formed in the front wall by being extended forward from the front wall.

The drum 30 has a plurality of lifts (not shown) on an inside wall for lifting and dropping the laundry.

The drum back 32 is coupled to a spider 33 having a rotation shaft 40 connected thereto, to rotate the drum 30 following rotation of the rotation shaft 40.

The rotation shaft 40 is passed through the tub back wall 50 and rotatably supported by a bearing housing 71.

The bearing housing 71 having a bearing mounted therein supports the rotation shaft 40.

In rear of the bearing housing, there is a motor (not shown) mounted thereto, and the rotation shaft 40 is directly connected to the motor.

The tub back wall 50 is mounted in the rear opening 21*a* of the rear opening 21*a* of the tub rear 21.

Between an edge of the rear opening 21*a* and the tub back wall 50, there is a rear gasket 60 mounted thereto. The rear gasket 60 has a corrugation at middle, and there is an adequate gap maintained between the edge of the rear opening 21*a* and an outside circumference of the tub back wall 50.

Accordingly, no movement of the tub back wall is transmitted to the tub rear 21.

The rear gasket 60 serves to seal between the tub rear 21 and the rear gasket 60 and enable the tub back wall 50 to make a relative motion with respect to the tub rear 21.

The bearing housing 71 is suspended from a suspension unit. The suspension unit includes brackets 72 and 73 connected to the bearing housing 71 and suspensions 80 and 90 for elastic supporting or damping.

The left supporting bracket 72 and the right supporting bracket 73 are connected to the bearing housing 71, and have forward extensions from under the tub 20 connected to a left side elastic supporting member 82 and a right side elastic supporting member 83, respectively.

The left side elastic supporting member 82 and the right side elastic supporting member 83 may be cylindrical suspensions each having a spring mounted in a cylinder.

Under the bearing housing 71, there is a rear side elastic supporting member 81 connected thereto. The rear side elastic supporting member 81 can also be a cylindrical suspension.

The cylindrical suspension can include a cylinder, a piston slidably mounted in the cylinder, and a spring connected between the piston and the cylinder for damping movement of the piston. The piston can be fabricated to slide in the cylinder while overcoming a friction. In that case, the cylinder has a damping function for vibration.

The rear side elastic supporting member 81, the left side elastic supporting member 82 and the right side elastic supporting member 83 are connected to the bottom panel 14 of the cabinet 10 at triangular positions, for supporting the drum 30 and damping vibration of the drum 30.

The left side elastic supporting member 82 and the right side elastic supporting member 83 are arranged symmetry in left/right directions with respect to the rotation shaft, and all of the elastic supporting members 81, 82 and 83 may be mounted in a vertical direction.

The elastic supporting members 81, 82 and 83 are connected to the left side bracket 72, the right side bracket 73 and the bearing housing 71 with hinges, and connected to the bottom panel 14 of the cabinet via rubber bushings, respectively. That is, the elastic supporting members 81, 82 and 83 are fixedly connected to the rubber bushings respectively, and, in turn, the rubber bushings are fixedly connected to the bottom panel 14, respectively. Owing to elasticity, the rubber bushings allow the elastic supporting members 81, 82 and 83 to rotate with respect to the bottom panel 14 to a certain extent. Accordingly, variation of upper side positions of the elastic supporting members 81, 82 and 83 are allowed, respectively. The rubber bushings support rotation and bending of the elastic supporting members 81, 82 and 83 in a damping fashion, respectively. That is, left/right direction, and front/rear direction horizontal movement of the drum is damped and supported by the rubber bushings.

Between the supporting brackets 72 and 73 and the bottom panel 14, there are a left side damper 91 and a right side damper 92 mounted thereto, respectively. The left side damper 91 and the right side damper 92 are connected to the supporting brackets 72 and 73 and the bottom panel 14 with hinges, respectively.

The left side damper 91 and the right side damper 92 are mounted tilted in front/rear directions. Though a direction of the tilting is forward in the drawing, the direction of the tilting may be backward.

Both the left side damper 91 and a light side damper 92 are cylindrical. A piston in the cylinder slides on an inside wall of the cylinder against a friction to perform a damping function.

The tub extended portion 23*a* of the tub front 23 has a tub water supply portion 140 and an injection portion 130. The tub water supply portion 140 is connected to the detergent box 120 through the water supply hose 121, and the injection portion 130 is connected to the circulating pump 110 and the steam generator 100 through a first hose 111 and a second hose 101, respectively.

The tub water supply portion 140 and the injection portion 130 are positioned on a front side of the drum 30 for supplying the water or the steam to an inside of the drum 30 from an upper side to a lower side and from a front side to a rear side. Such directions of supply allow a fluid being supplied thus is supplied to an inside of the drum 30, smoothly.

The tub water supply portion 140 will be described with reference to FIGS. 2 to 6.

Figure 2:
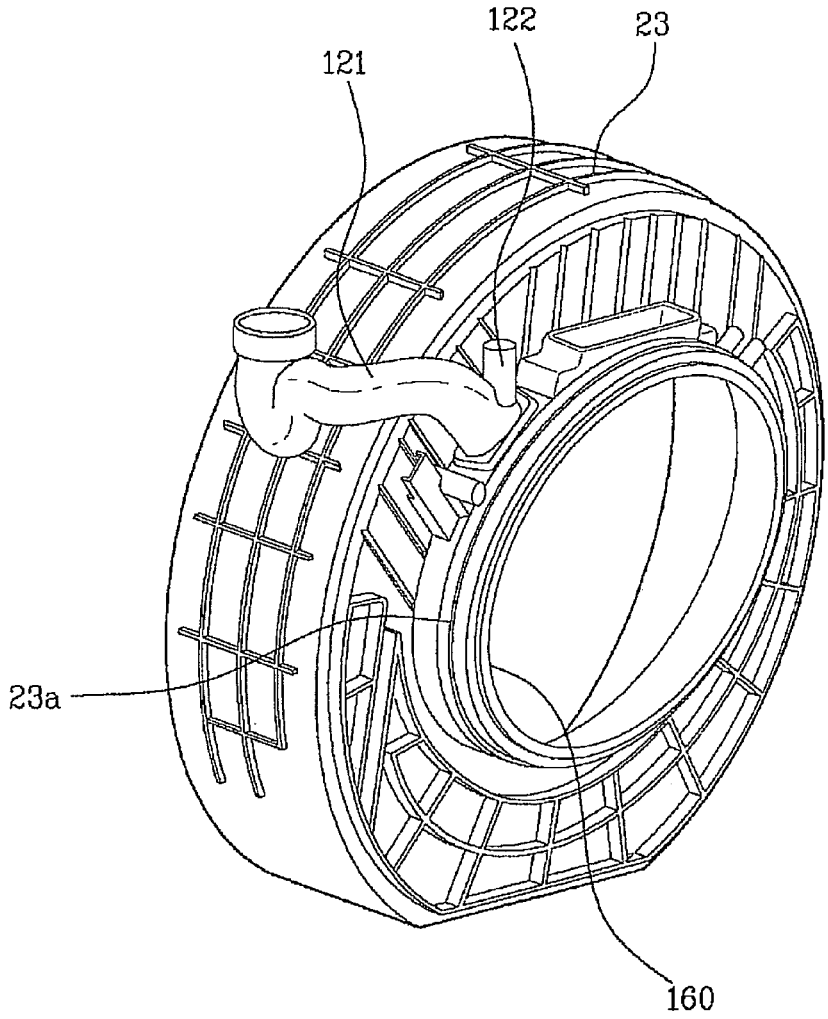
FIG. 2 illustrates a perspective view of the tub water supply portion in FIG. 1.
Figure 3:
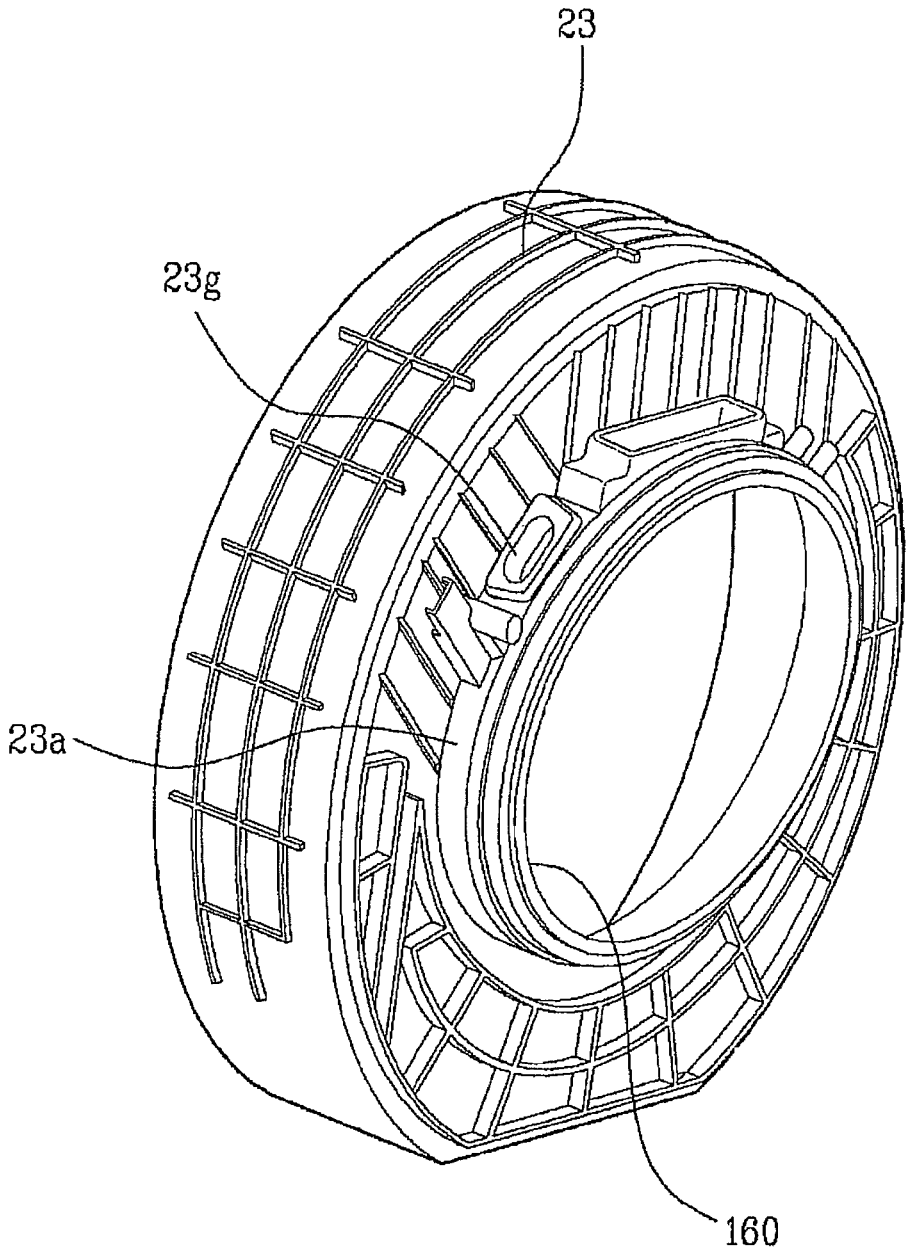
FIG. 3 illustrates the tub water supply portion in FIG. 2 having the water supply hose removed therefrom.

FIG. 2 illustrates the tub water supply portion 140 having the water supply hose 121 connected thereto. FIG. 3 illustrates the tub front 23 in a state the water supply hose 121 is removed.

The tub extended portion 23*a* of the tub front 23 has a water supply hole 23*g* formed therein. As shown in FIG. 12, the water supply hose 121 is placed to an inside of the water supply hole 23*g*.

Referring to FIG. 1, the water supply hose 121 is connected to the detergent box 120 such that the water is supplied to the tub water supply portion 140 through the detergent box 120. As shown in FIG. 2, the water supply hose 121 has a U shaped portion connected to the detergent box. Though not shown, the tub has a rib for seating the U shaped portion thereon. The rib supports the U shaped portion. Since the U shaped portion may hold water that is liable to lead disconnection of the U shaped portion from the detergent box by gravity, it is preferable that the U shaped portion is supported by the rib.

Though not shown, the detergent box 120 is connected to the water supply valve connected to water supply system such that the water supply system is supplied to the detergent box 120 through the water supply valve. Then, the water from the detergent box 120 is supplied to the tub 20 via the tub water supply portion 140 through the water supply hose 121.

The water supply hose 121 has a coupling groove 121*a* in an outside circumference for placing in an edge of the water supply hole 23*g* such that the water supply hose 121 is coupled to the water supply hole 23*g*, securely.

A front gasket 160 mounted to the tub extended portion 23*a* has a water flow guide 161 at a position opposite to the water supply hole 23*g*. The water flow guide 161 guides the water from the water supply hose 121 to be directed toward an inside of the drum 30. In detail, the water flow guide 161 is sloped downward.

The water supply hose 121 may have a branch hose 122. The branch hose 122 is used when other fluid is supplied to the tub 20. The branch hose 122 may be used for supplying a fluid that can be added to the laundry other than the detergent. For an example, the branch hose 122 can be used for supplying an aromatic additive. Or, the branch hose 122 may be connected to the water supply system directly for supplying water which does not flow through the detergent box.

Figure 5:
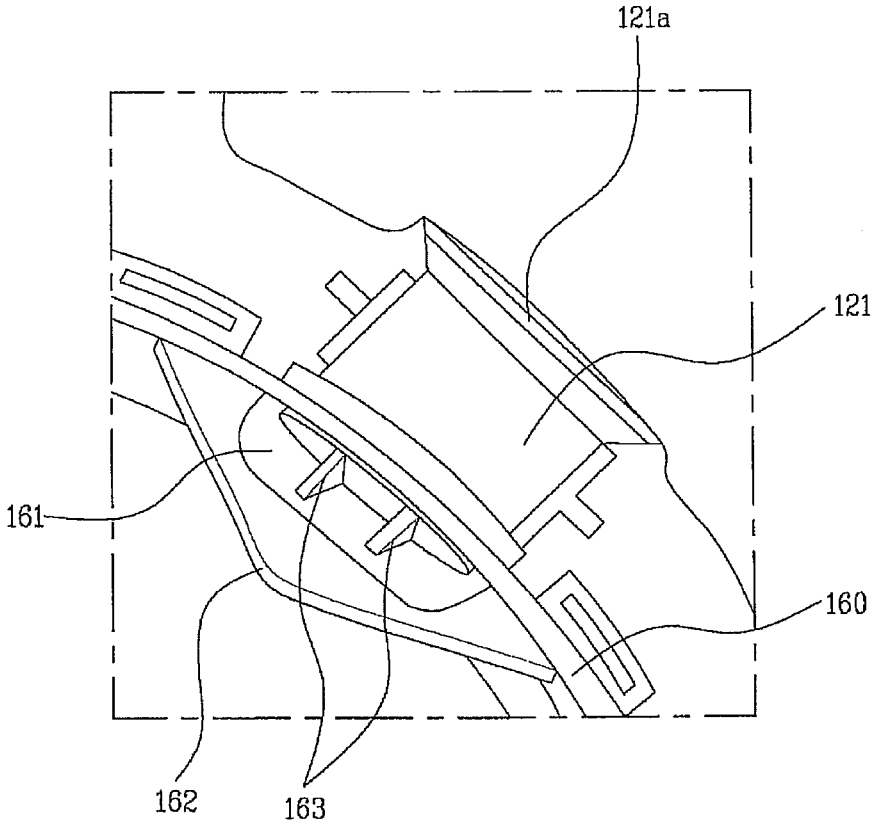
FIG. 5 illustrates a section of the tub water supply portion.

FIG. 5 illustrates the tub water supply portion 140 seen from an inside of the tub.

The water flow guide 161 at the front gasket 160 has ribs 163. The ribs 163 support the water flow guide 161. When the water is being supplied, since the water flow guide 161 is liable to sag down due to gravity of the water and the water flow guide 161, the ribs 163 support the water flow guide 161 for preventing the water flow guide 161 from sagging down. In detail, a portion where the front gasket 160 is connected to the tub extended portion 23*a* and an upper side surface of the water flow guide 161, the ribs 163 are formed.

Owing to the ribs 163 formed at the water flow guide 161, there can be spraying effect of the water. That is, the ribs 163 can divide the water being supplied.

Depending on cases, two or more than two hoses 121 can be connected, and the ribs 163 may be used to supply the fluids introduced thereto from different hoses 121 after separating the fluids.

Figure 4:
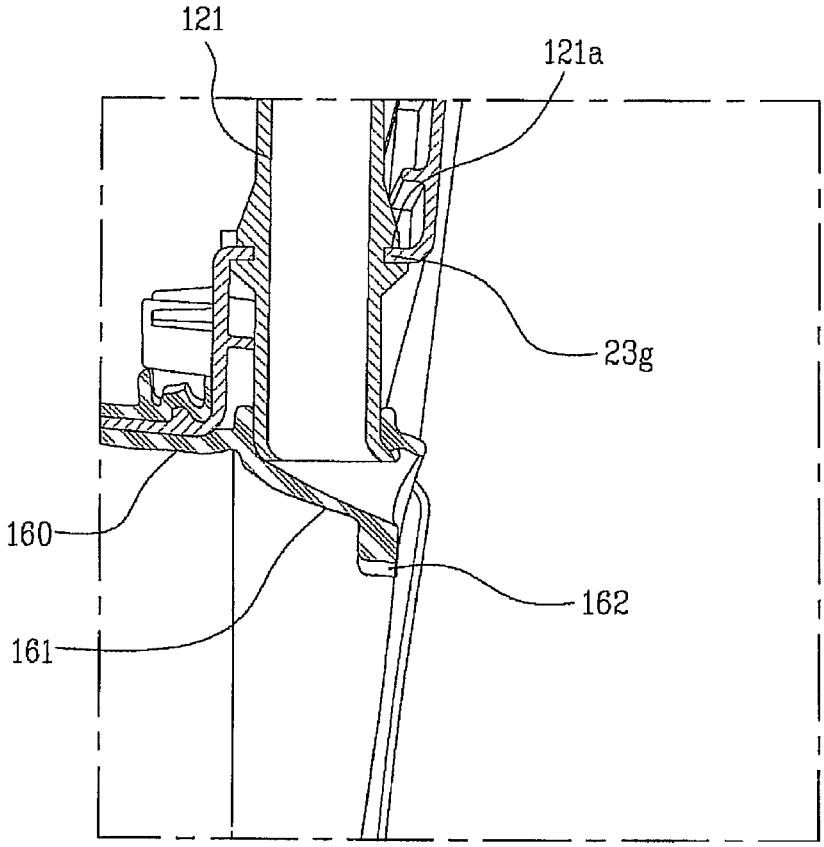
FIG. 4 illustrates a perspective view of the tub water supply portion in FIG. 1 seen from an inside of the tub.
Figure 6:
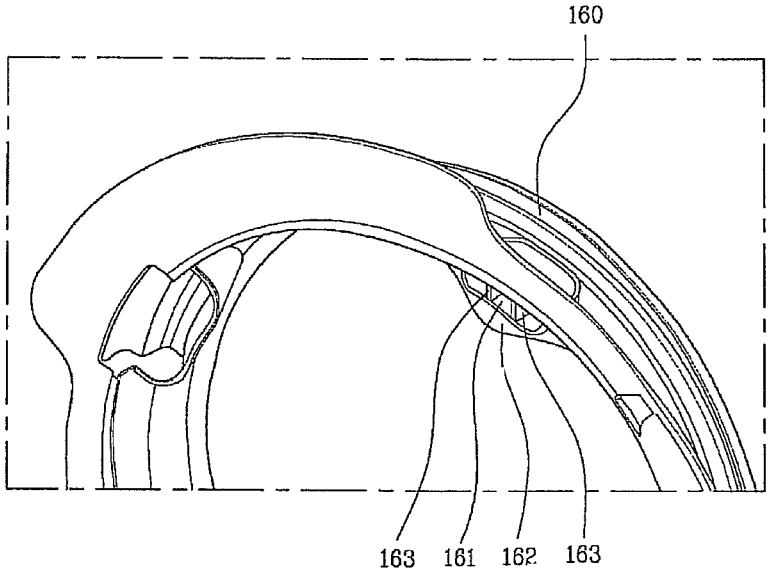
FIG. 6 illustrates a perspective view of a front gasket, partially.

Under the water flow guide 161, there is a guide plate 162 for guiding movement of the laundry. As shown in FIGS. 4 to 6, the guide plate 162 has a triangular shape under the water flow guide 161.

At the time the drum 30 rotates, the laundry in the drum 30 may come close to the tub water supply portion 140 as the laundry moves, when the guide plate 162 can serve to cut the coming closer of the laundry off the guide plate 162, making the laundry to move in a direction the laundry is designed to move.

INDUSTRIAL APPLICABILITY

The present invention relates to a laundry machine for treating laundry. The present invention provides a washing machine of a new structure having a tub water supply portion formed at a tub extended portion of a tub extended forward from the tub for introduction/taking out of the laundry. For, an example, in a case the water is guided to be directed toward an inside of a drum from a front thereof, the water is supplied to the laundry directly, enabling to obtain a good result only with a small amount of the water.

The invention claimed is:

1. A laundry machine comprising:

a water supply valve;

a drum in which laundry is placed, the drum having a laundry entrance opening;

a tub in which the drum is rotatably placed, the tub having a water supply hole in front of the laundry entrance opening of the drum, wherein the tub has an extension which extends forward from a front wall of the tub and wherein the water supply hole is provided at a lateral side surface thereof;

a water supply line to guide water from the water supply valve to the water supply hole; and a front gasket mounted to the extension and having a water flow guide at a position opposite to the water supply hole to direct the water toward the drum, wherein at least one rib is formed on an upper surface of the water flow guide, wherein the at least one rib comprises a first rib and a second rib horizontally spaced apart.

2. The laundry machine as claimed in claim 1, wherein the laundry machine further comprises a front frame forming a front outer appearance for the laundry machine, and an upper portion of the front wall of the tub is spaced away from the front frame.

3. The laundry machine as claimed in claim 2, wherein the water supply hole is located higher than a center of a laundry entrance opening of the drum.

4. The laundry machine as claimed in claim 2, wherein the extension extends to reach the front frame.

5. The laundry machine as claimed in claim 4, wherein the extension passes through a laundry entrance opening of the front frame.

6. The laundry machine as claimed in claim 1, wherein the water supply line passes through a detergent box.

7. The laundry machine as claimed in claim 1, wherein the water supply line comprises a water supply hose of which an end is placed inside the extension of the tub through the water supply hole.

8. The laundry machine as claimed in claim 7, wherein the water supply hose has a assembling groove in which an inner circumferential edge of the water supply hole is inserted.

9. The laundry machine as claimed in claim 7, wherein the water supply hose has a branch hose which is branched from the water supply hose.

10. The laundry machine as claimed in claim 1, further comprising:

a rotational shaft connected to the drum;

a bearing housing to rotatably support the shaft;

a motor to rotate the shaft; and a suspension unit attached to the bearing housing for reducing vibration of the drum.

11. The laundry machine as claimed in claim 10, wherein the tub is supported more rigidly than the drum being supported by the suspension unit.

12. The laundry machine as claimed in claim 1, further comprising:

a driving assembly comprising a rotational shaft connected to the drum, a bearing housing to rotatably support the rotational shaft, and a motor to rotate the rotational shaft; and a flexible material to prevent the water inside the tub from leaking toward the driving assembly and allow the driving assembly to move relatively to the tub.

13. The laundry machine as claimed in claim 1, wherein the first rib and the second rib divide the water supplied from the water supply line to spread the water throughout the drum.

14. The laundry machine as claimed in claim 1, wherein the water flow guide is made of a flexible material.

* * * * *